US007310484B2

(12) United States Patent
Namba

(10) Patent No.: US 7,310,484 B2
(45) Date of Patent: Dec. 18, 2007

(54) APPARATUS FOR FORMING VISIBLE BLACK AND WHITE OR COLOR IMAGES AND INVISIBLE IMAGES

(75) Inventor: Haruyuki Namba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 6 days.

(21) Appl. No.: 11/224,956

(22) Filed: Sep. 14, 2005

(65) Prior Publication Data

US 2006/0216051 A1 Sep. 28, 2006

(30) Foreign Application Priority Data

Mar. 24, 2005 (JP) ..... 2005-087123

(51) Int. Cl.
*G03G 15/01* (2006.01)

(52) U.S. Cl. ..... 399/54; 399/223

(58) Field of Classification Search ..... 399/54, 399/223, 228, 299, 306
See application file for complete search history.

(56) References Cited

U.S. PATENT DOCUMENTS 5,206,101 A * 4/1993 Schonenberg ..... 430/44
5,260,753 A * 11/1993 Haneda et al. ..... 399/54
5,797,070 A * 8/1998 Waki et al. ..... 399/149
5,926,679 A * 7/1999 May et al. ..... 399/296
6,167,224 A * 12/2000 Dalal ..... 399/222
6,704,538 B2 * 3/2004 Nakamura et al. ..... 399/336
6,993,269 B2 * 1/2006 Yamauchi et al. ..... 399/130
2002/0150830 A1 * 10/2002 Katagiri et al. ..... 430/108.24
2003/0175608 A1 * 9/2003 Takagi et al. ..... 430/108.6

FOREIGN PATENT DOCUMENTS

JP 2001-05305 1/2001
JP 2002-240387 8/2002
JP 2003-186238 7/2003
JP 2004-12880 1/2004

* cited by examiner

*Primary Examiner*—Quana Grainger
(74) *Attorney, Agent, or Firm*—Morgan, Lewis & Bockius LLP

(57) ABSTRACT

The image forming apparatus of the present invention includes a cyan color image formation unit which uses a cyan color toner to form a cyan color image; a magenta color image formation unit which uses a magenta color toner to form a magenta color image; a yellow color image formation unit which uses a yellow color toner to form a yellow color image; a black color image formation unit which uses a black color toner to form a black color image; an invisible image formation unit which uses an invisible toner to form an invisible image; and a control apparatus which, when only the black color toner and the invisible toner are used for formation of an image, stops respective image formation operations of the cyan color image formation unit, the magenta color image formation unit and the yellow color image formation unit.

10 Claims, 8 Drawing Sheets

APPARATUS FOR FORMING VISIBLE BLACK AND WHITE OR COLOR IMAGES AND INVISIBLE IMAGES

CROSS-REFERENCE TO RELATED APPLICATION

This application claims priority under 35 USC 119 from Japanese Patent Application No. 2005-087123, the disclosure of which is incorporated by reference herein.

BACKGROUND OF THE INVENTION

1. Field of the Invention

The present invention relates to an image forming apparatus such as a copying machine, a printer or the like, and particularly relates to an image forming apparatus which is capable of forming an invisible image together with a visible color/monochrome image.

2. Description of the Related Art

An image forming apparatus is known which charges an image carrier such as a photosensitive material or the like to prepare an electrostatic latent image, forms a toner image on the image carrier by developing with toner, transfers the toner image directly or through an intermediate transfer element onto a recording medium, and fixes the toner image. Among such image forming apparatuses, a tandem type color image forming apparatus is widely known, which includes separate image formation units for forming toner images of four colors, i.e., Y (yellow), M (magenta), C (cyan), and K (black). The apparatus separately forms toner images of the YMCK four colors on image carriers in the respective image formation units, and carries out multiple transfer to form a color image, thus having enhanced productivity of color images.

However, even with a color image forming apparatus, documents of only K color (black and white images) are often printed out. When such a document is to be printed out (in other words, when a black and white image is to be formed by using only K color toner), in general, only the image formation unit for K color carries out image formation operation, while the image formation operations by the image formation units for the colors other than K color are not performed, from the viewpoint of prevention of scratch damage and wear of the image carrier, and degradation of the developer, and the like. In addition, a transfer feed apparatus for an image forming apparatus is known, in which a support member is movably provided for supporting a transfer material feed belt from its rear surface side. In a black and white image formation mode, the support member can be moved to separate the transfer material feed belt from chromatic color recording photosensitive materials (for example, referring to Japanese Patent Laid-Open (JP-A) 2001-005305).

In recent years, the trend of utilizing additional information embedding technology has become striking in which additional information is superposingly embedded into an image in order to protect copyright and prevent illegal copying of a digital literary work such as a static image and the like. Examples of the known additional information embedding art include an image forming apparatus and an image forming method for forming a visible image using ordinary toners of YMCK colors and an invisible image using invisible toner having infrared light absorbency on an image output medium such as a recording paper or the like. Security information or the like is embedded into the invisible image, which aims at improving security functions such as counterfeit prevention, counterfeit deterrence, originality certification and the like. Further, coordinate information or the like is embedded into the invisible image, which aims at increasing the added value of the output medium (see, for example, JP-A 2004-012880, JP-A 2003-186238, and JP-A 2002-240387).

An image formation unit for forming an invisible image using the above-mentioned invisible toner can be added to the above-mentioned conventional tandem-type color image forming apparatus. Thus five image formation units are used to form an invisible image together with a color visible image, and additional information can be embedded into the output image.

However, the conventional color image forming apparatus has not taken into account an application where a black and white image is to be formed together with an invisible image, and provides no configuration suited for prevention of degradation of an image carrier, a developer and the like, or prevention of loss of an invisible image.

SUMMARY OF THE INVENTION

The present invention has been made in view of the above circumstances and provides an image forming apparatus.

An image forming apparatus of a first aspect of the present invention is configured to include a cyan color image formation unit which uses a cyan color toner to form a cyan color image, a magenta color image formation unit which uses a magenta color toner to form a magenta color image, a yellow color image formation unit which uses a yellow color toner to form a yellow color image, a black color image formation unit which uses a black color toner to form a black color image, an invisible image formation unit which uses an invisible toner to form an invisible image, and a control apparatus which, when only the black color toner and the invisible toner are used for formation of an image, functions so as to stop respective image formation operations of the cyan color image formation unit, the magenta color image formation unit and the yellow color image formation unit.

BRIEF DESCRIPTION OF THE DRAWINGS

An embodiment of the present invention will be described in detail based on the following figures, wherein.

DETAILED DESCRIPTION OF THE INVENTION

Hereinbelow, an embodiment of the present invention will be described in detail with reference to the drawings.

Figure 1:
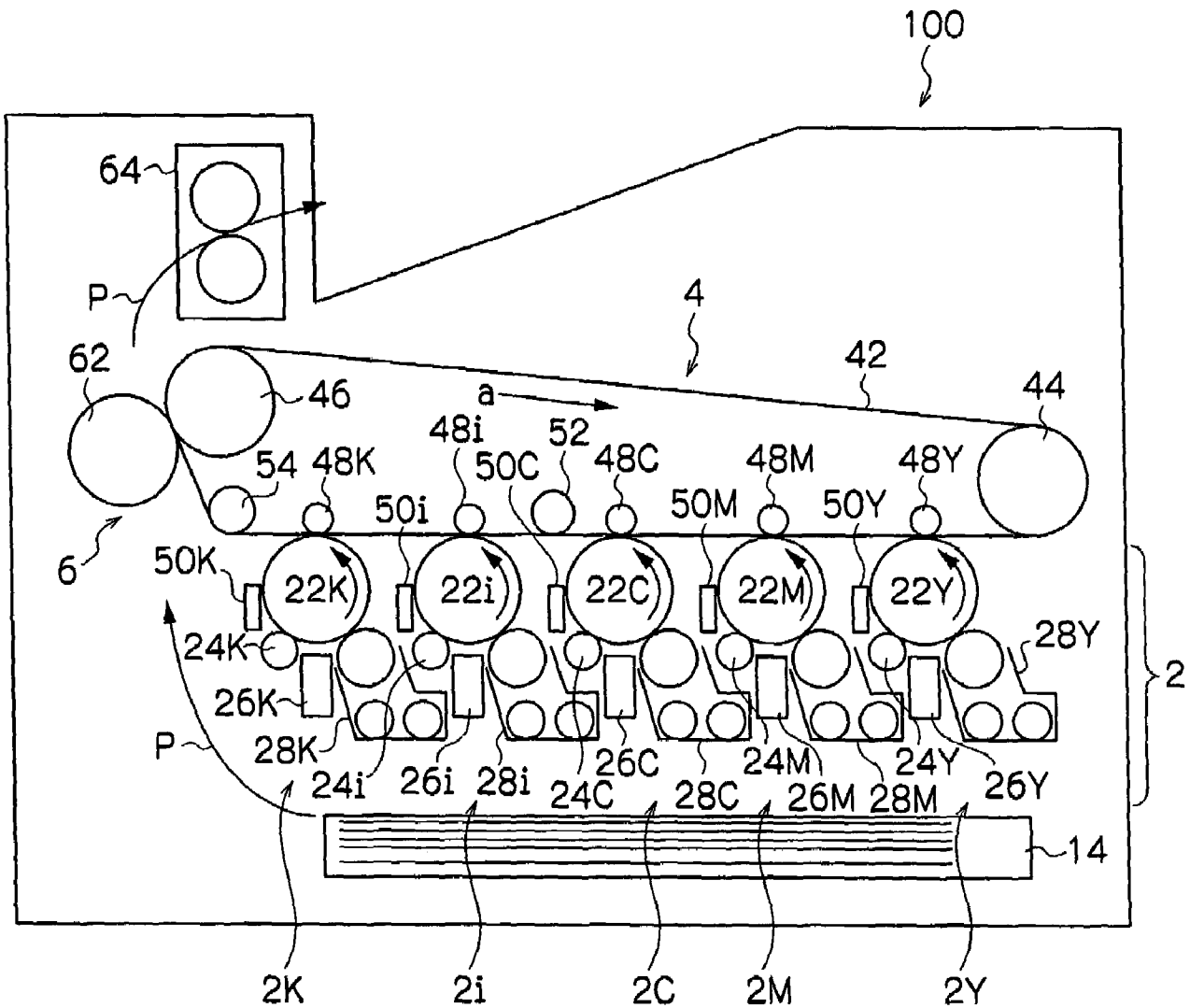
FIG. 1 is a drawing illustrating a schematic configuration of an image forming apparatus pertaining to the embodiment of the present invention.

FIG. 1 is a drawing illustrating a schematic configuration of an image forming apparatus 100 pertaining to the present embodiment. FIG. 1 shows only an IOT (Image Output Terminal, i.e., an image output section), and illustration of the configuration of an image reading section and an electrical system (a control system) is omitted.

This image forming apparatus 100 includes an intermediate transfer belt 42 which is formed like an endless belt, running in the direction as shown with an arrow "a" in FIG. 1; an image forming section 2 which is disposed under the intermediate transfer belt 42, essentially composed of five image formation units for forming visible images of different colors (and an invisible image), using mutually different developers; a primary transfer unit 4 which primarily transfers an image formed in the image forming section 2 to the outer surface of the intermediate transfer belt 42; a secondary transfer unit 6 which transfers an image primarily transferred from the image forming section 2 to the intermediate transfer belt 42 to a recording paper; and a fixing apparatus 64 which fixes an image secondarily transferred.

The image forming section 2 is configured, with five image formation units, i.e., a Y image formation unit 2Y for forming a Y (yellow) color image, an M image formation unit 2M for forming an M (magenta) color image, a C image formation unit 2C for forming a C (cyan) color image, an i image formation unit 2*i* for forming an invisible image, and a K image formation unit 2K for forming a K (black) color image being disposed tandem in this order from the upstream side toward the downstream side along the running direction "a" (the process direction) for the intermediate transfer belt 42.

The i image formation unit 2*i* is an image formation unit for forming an invisible image using invisible toner (hereinbelow, i toner) which has infrared light absorbency. The invisible toner is brought into an invisible state (the state in which visual recognition is difficult or impossible) under ordinary visible light, and brought into a visible state (the state in which visual recognition is possible) when irradiated with infrared light.

Figure 4:
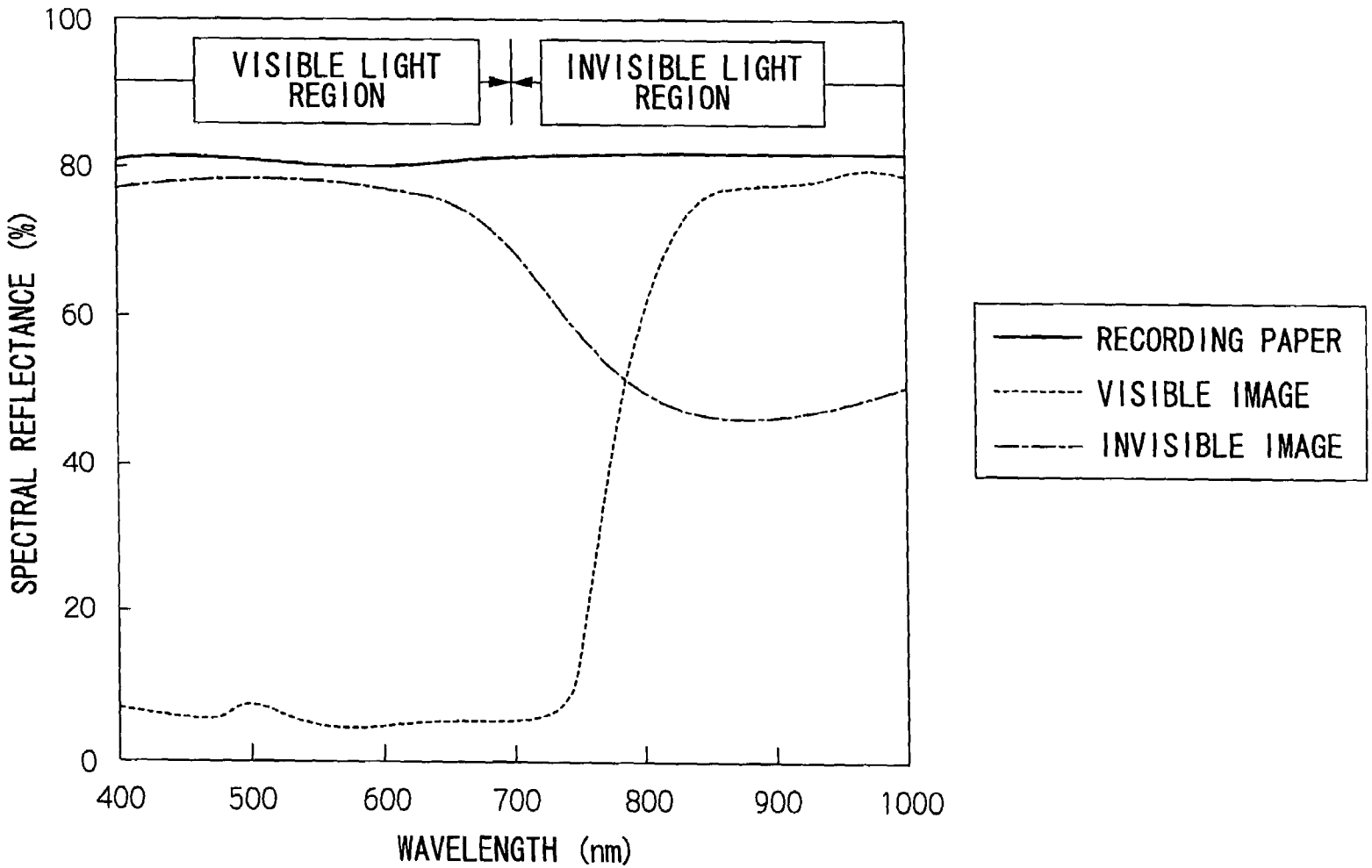
FIG. 4 is a diagram giving the spectral reflectance characteristics of recording paper, a visible image, and an invisible image.

FIG. 4 is a diagram giving the spectral reflectance characteristics of recording paper, a visible image, and an invisible image. As shown in the same diagram, a Y color image, an M color image, a C color image, or a visible image like a color image formed by superimposing them has a low spectral reflectance for light in the visible light region, and has a high spectral reflectance for light in the infrared light region. On the other hand, an invisible image formed by using the i toner has a high spectral reflectance for light in the visible light region, and has a low spectral reflectance for light in the infrared light region. Therefore, an invisible image having an infrared light absorbing characteristic becomes visually recognizable when irradiated with infrared light.

Such an invisible image may, of course, be made up of image components such as a character, a digit, a symbol, a pattern, a photograph and the like, and may be a well-known 2-D pattern such as a bar cord or the like. Such an invisible image can include a serial number for identifying the image forming apparatus which has formed the image on the image output medium, or the copyright certification number for the visible image formed together with the invisible image on the surface of the image output medium, or the like. In addition, in case when the visible image formed together with an invisible image takes a form of a confidential document, a negotiable instrument, a license, a personal ID card or the like, the invisible image can be effectively used for determining whether such a visible image is a counterfeit of the original visible image or not.

By forming such an invisible image on the surface of the image output medium, it may be made possible to embed information consuming a large amount of memory space, such as music information, an electronic file of text-writing application software or the like in the image in the form which cannot be visually understood, and to prepare a more sophisticated confidential document, a document having both digital and analog information and the like.

Figure 5B:
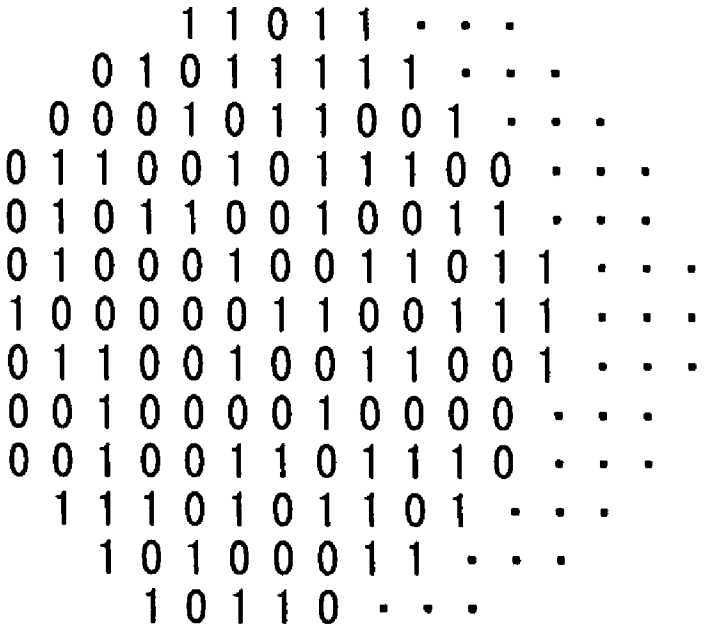
FIG. 5B is a schematic view showing an example of a bit information image when the enlarged view is decoding-converted into digital information by mechanical reading.
Figure 5A:
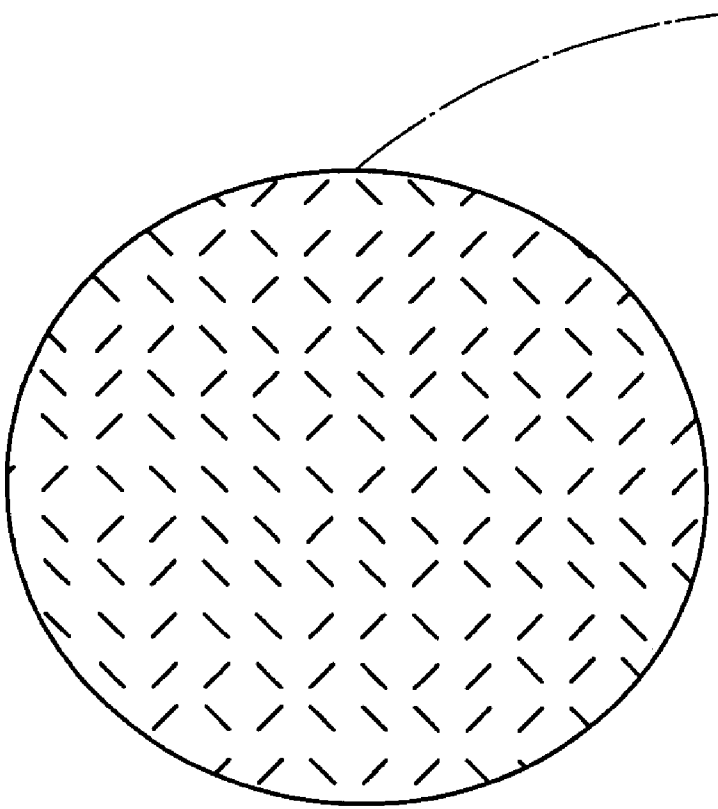
FIG. 5A is an enlarged view of an image which is recognized when an invisible image configured from a 2-D pattern formed by the i image formation unit 2*i* is irradiated with infrared light.

FIG. 5A is an enlarged view of an image which is recognized when an invisible image configured from a 2-D pattern formed by the i image formation unit 2*i* is irradiated with infrared light. FIG. 5B is a schematic view showing an example of a bit information image when the enlarged view is decoding-converted into digital information by mechanical reading.

In the image as shown in FIG. 5A, two different types of minute lines having mutually different inclinations are arranged. One of the inclinations denotes bit information of "0", and the other bit information of "1". In FIG. 5B, the bit information is grasped as an image, and thereby, the original information can be decoded into information such as voice information, a text, an image file, an electronic file of application software or the like, in the format corresponding to the recording format at the time of the encoding.

Any invisible image can be formed with the use of the above-mentioned i toner by employing the well-known recording method conventionally used as a method for recording a visually recognizable image. Therefore, the i image formation unit 2*i* can have the same configuration as the other image formation units.

As shown in FIG. 1, the Y image formation unit 2Y, the M image formation unit 2M, the C image formation unit 2C, the K image formation unit 2K, and the i image formation unit 2*i* include respectively a photosensitive material drum 22Y, 22M, 22C, 22K, 22*i*; a contact type charger 24Y, 24M, 24C, 24K, 24*i* which charges the surface of the photosensitive material drum 22Y, 22M, 22C, 22K, 22*i*, respectively; an exposure apparatus 26Y, 26M, 26C, 26K, 26*i* which exposes the charged photosensitive material drum 22Y, 22M, 22C, 22K, 22*i*, respectively, to form an electrostatic latent image; a developing apparatus 28Y, 28M, 28C, 28K,

28*i* which adheres a yellow color toner, magenta color toner, cyan color toner, black color toner, and i toner to the surface of the photosensitive material drum 22Y, 22M, 22C, 22K, 22*i* on which an electrostatic latent image is formed, respectively, forming a Y color image, M color image, C color image, K color image, and invisible image, respectively; and a cleaner 50Y, 50M, 50C, 50K, 50*i* which cleans the surface of the photosensitive material drum 22Y, 22M, 22C, 22K, 22*i*, respectively, to remove the waste toner as a transfer residual, and the like, after the primary transfer.

The primary transfer unit 4 includes a feed roller 44 which is turned, while being butted against the inner surface of the intermediate transfer belt 42, for running the intermediate transfer belt 42 in the direction of the arrow "a"; a backup roller 46 which cooperates with the feed roller 44 to hold the intermediate transfer belt 42 in a state of tension, and at the same time constitutes a part of the secondary transfer unit 6; an auxiliary roller 52, 54 which is turned by the turning of the feed roller 44, while being butted against the inner surface of the intermediate transfer belt 42; a transfer roller 48Y which transfers a Y image formed by the Y image formation unit 2Y to the outer surface of the intermediate transfer belt 42; a transfer roller 48M which transfers an M image formed by the M image formation unit 2M to the outer surface of the intermediate transfer belt 42; a transfer roller 48C which transfers a C image formed by the C image formation unit 2C to the outer surface of the intermediate transfer belt 42; a transfer roller 48*i* which transfers an invisible image formed by the i image formation unit 2*i* to the outer surface of the intermediate transfer belt 42; and a transfer roller 48K which transfers a K image formed by the K image formation unit 2K to the outer surface of the intermediate transfer belt 42.

The transfer rollers 48Y, 48M, 48C, 48*i*, and 48K are transfer rollers which are turned, while being butted against the inner surface of the intermediate transfer belt 42, to charge the intermediate transfer belt 42 for transferring the Y color image, M color image, C color image, invisible image, and K color image to the intermediate transfer belt 42, respectively, being disposed along the running direction "a" for the intermediate transfer belt 42 in the order of the transfer rollers 48Y, 48M, 48C, 48*i*, and 48K. The transfer rollers 48Y, 48M, 48C, 48*i*, and 48K are respectively connected to the primary transfer bias power supply (later described), from which a prescribed voltage is respectively applied thereto.

In the primary transfer unit 4, the transfer rollers 48*i* and 48K, the backup roller 46, and the auxiliary rollers 52 and 54 are fixedly disposed. On the other hand, the feed roller 44, the transfer rollers 48Y, 48M and 48C are vertically movably disposed.

A support member (not shown) for supporting the roller shaft of the feed roller 44 is vertically moved by a motor (not shown). With the support member being moved vertically, the feed roller 44 is moved in the vertical direction. In addition, support members for supporting the roller shafts of the transfer rollers 48Y, 48M, and 48C on the upstream side in the process direction of the auxiliary roller 52 which is fixedly disposed are vertically moved by the motor (not shown). With the support members being moved vertically, the transfer rollers 48Y, 48M, and 48C are moved in the vertical direction.

As shown in FIG. 1, when the system is in the initial state, or a color image is to be formed, the feed roller 44 and the transfer rollers 48Y, 48M and 48C are disposed in the respective downward positions thereof. Thereby, the outer surface of the intermediate transfer belt 42 is butted against the photosensitive material drum 22Y, 22M, 22C, 22*i* and 22K of all the image formation units.

Figure 2:
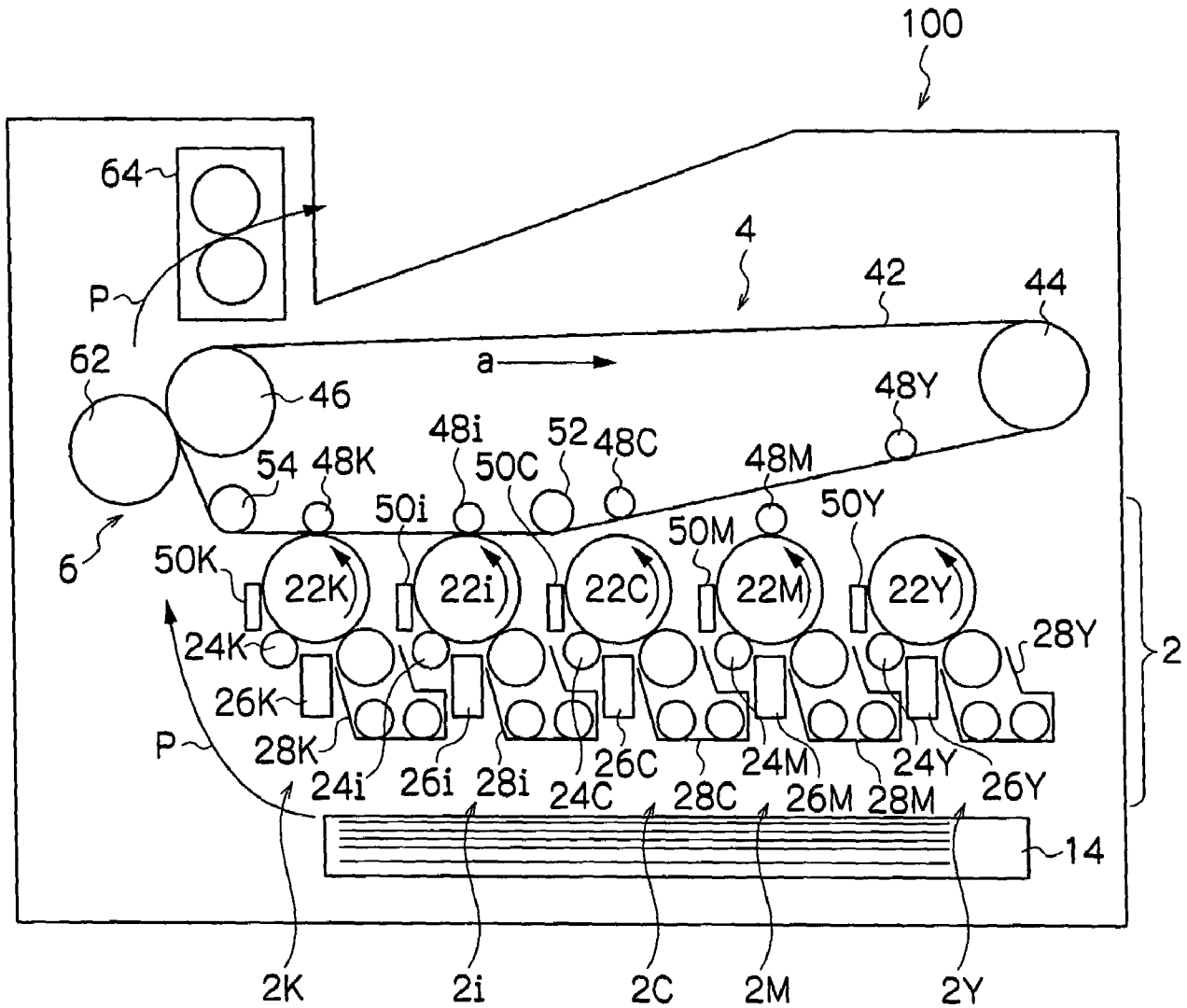
FIG. 2 is a drawing illustrating the shift of the intermediate transfer belt when a black and white image is to be formed.

In addition, as shown in FIG. 2, when a black and white image is to be formed, the feed roller 44 and the transfer rollers 48Y, 48M and 48C are disposed in the respective upward positions thereof. Thereby, the outer surface of the intermediate transfer belt 42 is separated from the photosensitive material drums 22Y, 22M and 22C, being butted against only the photosensitive material drums 22*i* and 22K.

Under the image formation unit 2, a tray 14 containing recording papers onto which a toner image transferred to the intermediate transfer belt 42 is to be transferred is disposed. An arrow "P" indicates the feed path for the recording paper.

The secondary transfer unit 6 includes a secondary transfer roller 62 which is disposed on the opposite side of the backup roller 46, sandwiching the intermediate transfer belt 42 between it and the backup roller 46, and is turned, while pressing the recording paper against the outer surface of the intermediate transfer belt 42, for transferring a Y image, M image, C image, K image, and invisible image transferred on the outer surface of the intermediate transfer belt 42 to the recording paper; and a fixing apparatus 64 which is disposed above the backup roller 46, and fixes the toner image transferred to the recording paper by the secondary transfer roller 62.

Figure 3:
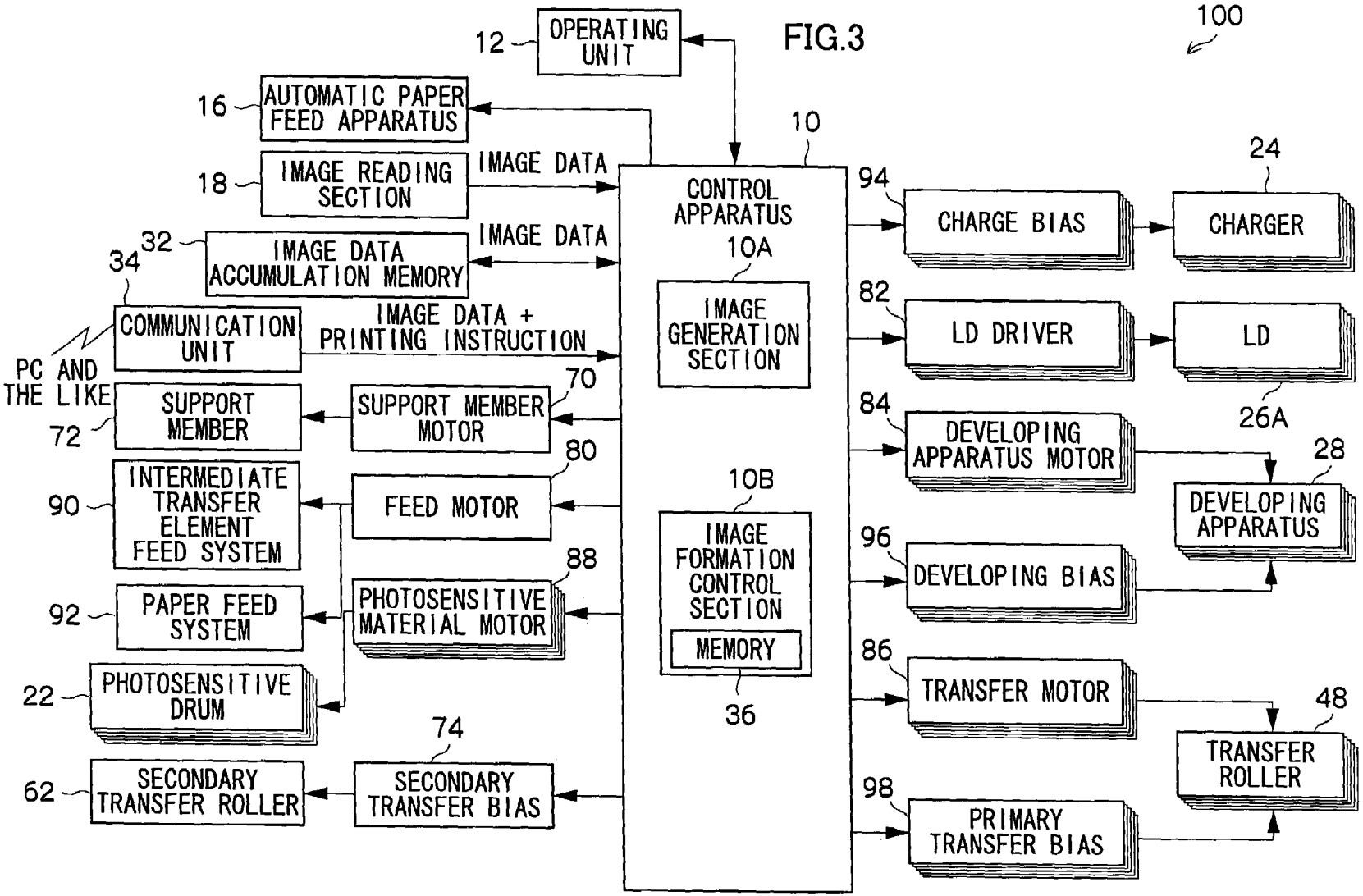
FIG. 3 is a block diagram illustrating a configuration of an electrical system of the image forming apparatus.

FIG. 3 is a block diagram illustrating the configuration of the electrical system of the image forming apparatus 100. Hereinbelow, when the Y image formation unit 2Y, the M image formation unit 2M, the C image formation unit 2C, the K image formation unit 2K, and the i image formation unit 2*i* are not to be particularly distinguished from one another for description, the respective image formation units are simply referred to as the image formation unit 2. In addition, the respective components constituting the respective image formation units 2 or the respective components provided correspondingly to each of the image formation units 2 in the image forming apparatus 100 will also be described with the tail symbol (Y, M, C, K, i) being omitted.

As shown in FIG. 3, with the image forming apparatus 100, an operating unit 12, a automatic paper feed apparatus 16, an image reading section 18, an image data accumulation memory 32, and a communication unit 34 are connected to a control apparatus 10, respectively.

The control apparatus 10 causes the image reading section 18 to read out the document in accordance with a printing instruction (a copying instruction) inputted from the operating unit 12. At this time, when it is detected that a document or documents are loaded in the automatic paper feed apparatus 16, the control apparatus 10 operates the automatic paper feed apparatus 16 to guide the loaded documents one by one to a platen glass to cause the image reading section 18 to read out the document.

Into the control apparatus 10, image data representing an image recorded on the document is inputted as a result of reading by the image reading section 18. In the control apparatus 10, image data and a printing instruction for the image data which have been sent from an external apparatus, such as a PC or the like are also inputted, being received by a communication unit 34.

Examples of the input item for the printing instruction include document size, document size automatic discrimination, printing color (color/black and white), whether an invisible image is to be printed or not, specification for layout for printing format, enlargement/reduction setting, printing paper size, and number of sets, and the like.

In addition, the image reading section 18 and the communication unit 34 are also connected to the image data accumulation memory 32, and the control apparatus 10 can cause the image data acquired by the image reading section 18 or the data received by the communication unit 34 to be stored in the image data accumulation memory 32 in accordance with the instruction inputted through the operating unit 12 or the communication unit 34. The image data stored in the image data accumulation memory 32 is read out by the control apparatus 10 with a prescribed printing timing (at the previously set time, the time when the printing is instructed by the user or the like).

The control apparatus 10 controls the operation of the IOT such that the image based on the image data thus inputted (or read out) is outputted printed in accordance with the printing instruction.

Further, the image forming apparatus 100 includes a feed motor 80, an LD driver 82 for lighting and driving the LD 26A for the exposure apparatus 26, a motor 84 for driving the developing apparatus 28 (hereinbelow, referred to as "developing apparatus motor"), a motor 86 for moving the transfer roller 48 (hereinbelow, referred to as "transfer motor"), and a motor 88 for turning the photosensitive material drum 22 (hereinbelow, referred to as "photosensitive material motor"). These feed motor 80, LD driver 82, developing apparatus motor 84, transfer motor 86, and photosensitive material motor 88 are connected to the control apparatus 10, respectively.

The feed motor 80 is connected to an intermediate transfer element feed system 90 for moving the intermediate transfer belt 42, including the feed roller 44, and a paper feed system 92 for feeding a recording paper. When the feed motor 80 is driven, the turning force thereof is transmitted to the intermediate transfer element feed system 90, and the paper feed system 92 for moving the intermediate transfer belt 42 in the direction of the arrow "a" as indicated in FIG. 1, and consecutively feeding the recording paper from the paper tray 14 to a delivery tray through the secondary transfer unit 6 along the feed path "P".

The photosensitive material motor 88 is provided for each image formation unit 2, and is connected to the photosensitive material drum 22 in the corresponding image formation unit 2. When the photosensitive material motor 88 is driven, the turning force thereof is transmitted to the photosensitive material drum 22 for turning the photosensitive material drum 22 in the direction of the arrow as indicated in FIG. 1.

The LD driver 82 is provided for each image formation unit 2, and is connected to an LD 26A, which is the light source for the exposure apparatus 26 in the corresponding image formation unit 2. To the LD driver 82, a lighting signal is inputted from the control apparatus 10, and the LD driver 82 turns ON/OFF the LD 26A on the basis of the lighting signal inputted.

The developing apparatus motor 84 is provided for each image formation unit 2. With the image forming apparatus 100, when this developing apparatus motor 84 is run, the turning force thereof is transmitted to the developing apparatus 28 in the corresponding image formation unit 2 for driving the developing apparatus 28.

The transfer motor 86 is provided for each image formation unit 2, and during printing, the running of this transfer motor 86 causes the transfer roller 48 in the corresponding image formation unit 2 to be pressed against or contacted with the circumferential surface of the photosensitive material drum 22.

In addition, a support member motor 70 is connected to the control apparatus 10. The support member motor 70 vertically moves a support member 72 which supports the respective roller shafts for the feed roller 44 and the transfer rollers 48Y, 48M and 48C.

The charger 24, the transfer roller 48, the developing apparatus 28, and the secondary transfer roller 62 require a high-voltage power supply. In order to supply a high-voltage power to them, the image forming apparatus 100 includes a bias power supply unit 94 for the charger (hereinbelow, referred to as "charge bias power supply"), a bias power supply unit 96 for the developing apparatus (hereinbelow, referred to as "developing bias power supply"), a bias power supply unit 98 for the transfer roller 48 (hereinbelow, referred to as "primary transfer bias power supply"), a bias power supply unit 74 for the secondary transfer roller 62 (hereinbelow, referred to as "secondary transfer bias power supply"). These charge bias power supply 94, developing bias power supply 96, primary transfer bias power supply 98, and secondary transfer bias power supply 74 are connected to the control apparatus 10, respectively.

The charge bias power supply 94 is provided for each image formation unit 2, and is connected to the charger 24 in the corresponding image formation unit 2 so as to be able to apply a high voltage thereto. In the image forming apparatus 100, when a high voltage is applied to the charger 24 from this charge bias power supply 94, a charging roller, which is the charger 24, is charged such that this charging roller can charge the photosensitive material drum 22.

The developing bias power supply 96 is provided for each image formation unit 2, and is connected to the developing apparatus 28 in the corresponding image formation unit 2 so as to be able to apply a high voltage thereto. In the image forming apparatus 100, when a high voltage is applied to the developing apparatus 28 from this developing bias power supply 96, the toner in the developing apparatus 28 is charged such that the toner can be electrostatically adhered to the latent image portion of the photosensitive material drum 22 to carry out development.

The primary transfer bias power supply 98 is provided for each image formation unit 2, and is connected to the transfer roller 48 in the corresponding image formation unit 2 so as to be able to apply a high voltage thereto. In the image forming apparatus 100, when a high voltage is applied to the transfer roller 48 from this primary transfer bias power supply 98, the transfer roller 48 is charged such that the toner image on the photosensitive material drum 22 can be electrostatically transferred to the intermediate transfer belt 42.

The secondary transfer bias power supply 74 is connected to the secondary transfer roller 62 so as to be able to apply a high voltage thereto. In the image forming apparatus 100, when a high voltage is applied to the secondary transfer roller 62 from this secondary transfer bias power supply 74, the secondary transfer roller 62 is charged such that the toner image on the intermediate transfer belt 42 can be electrostatically transferred to the recording paper.

In addition, in order to control the operation of the IOT, the control apparatus 10 includes the functions of an image generation section 10A and an image formation control section 10B for controlling the image formation operation.

The image generation section 10A generates, in accordance with a printing instruction, image data (raster data), which provides one full-page image, in which an image based on the image data is disposed on one recording paper page, that is, on a physical page.

The image formation control section 10B controls the image formation operation of the IOT by controlling the driving of the above-mentioned feed motor 80, LD driver 82, developing apparatus motor 84, transfer motor 86, and photosensitive material motor 88, and the turning ON/OFF or the application voltage level of the charge bias power supply 94, developing bias power supply 96, primary transfer bias power supply 98, and secondary transfer bias power supply 74.

In addition, the image formation control section 10B includes a program for controlling the image formation operation of the image formation unit 2 in accordance with the image data to be printed out, and a nonvolatile memory 36 which stores a variety of data.

Figure 6:
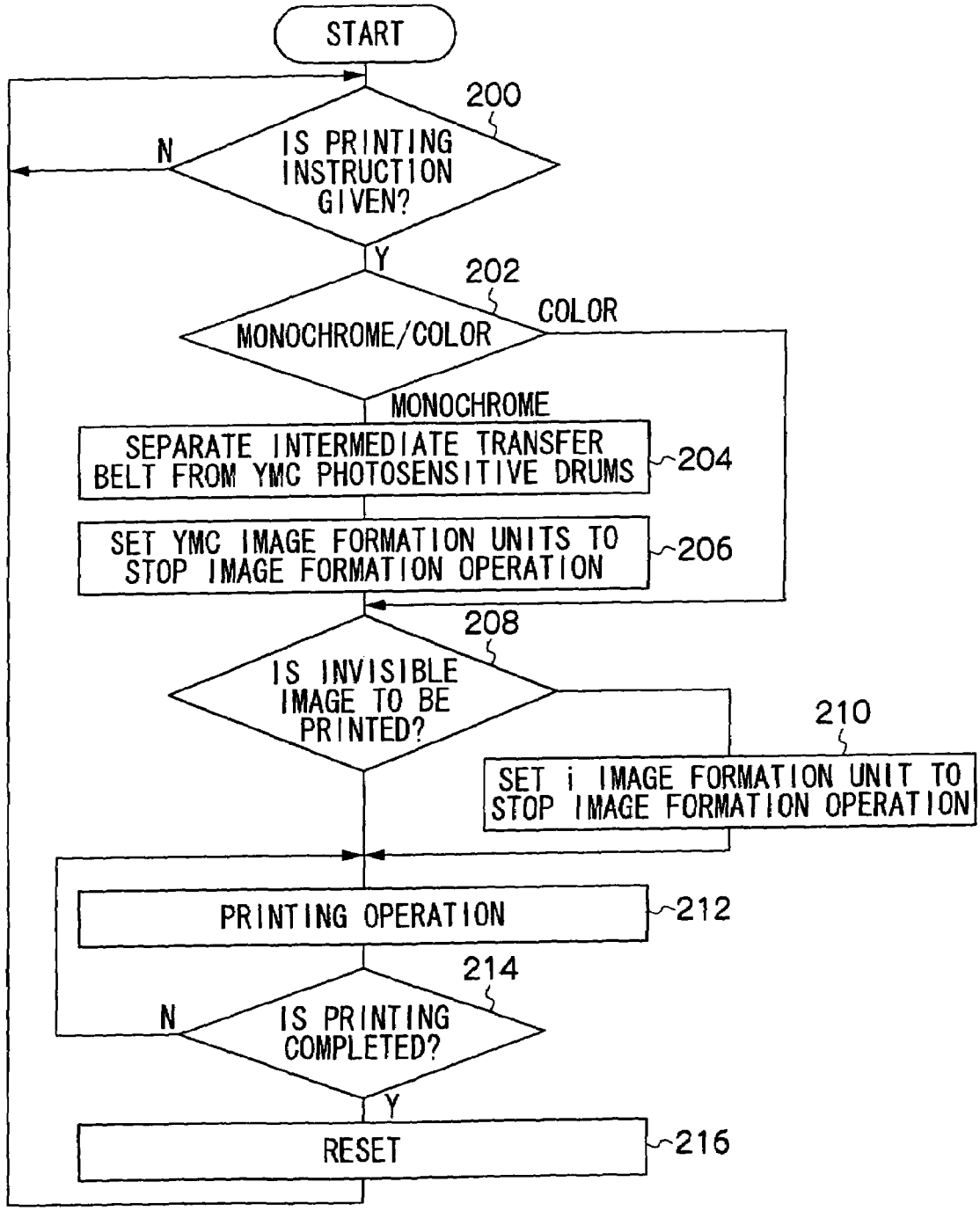
FIG. 6 is a flowchart illustrating a flow of the control of the image formation operation in the image forming apparatus.

Next, the control of the image formation operation in the image forming apparatus 100 will be described with reference to the flowchart as shown in FIG. 6.

At step 200, whether a printing instruction (a copying instruction) to be inputted from the operating unit 12 has been inputted, or image data and a printing instruction for the image data to be inputted from an external apparatus, such as a PC, or the like, through the communication unit 34 has been inputted is determined. Here, when it has been determined that the printing instruction has been inputted, whether the image data (or the document) for which printing has been instructed is of black and white or color is determined at step 202. When the printing instruction is a copying instruction, the determination is carried out from the image data obtained by reading out the document in the image reading section 18.

When, at step 202, it has been determined that the image data or document for which printing has been instructed is of black and white, the program proceeds to step 204 for driving the support member motor 70 to vertically move the support member 72 supporting the respective roller shafts for the feed roller 44 and the transfer roller 48Y, 48M, 48C for moving the feed roller 44 and the transfer roller 48Y, 48M, 48C to the upward position to separate the intermediate transfer belt 42 from the photosensitive material drum 22Y, 22M, 22C.

At step 206, the system is set such that the image formation operation of the Y image formation unit 2Y, the M image formation unit 2M, and the C image formation unit 2C are stopped. Specifically, the system is set such that, in each of the Y image formation unit 2Y, the M image formation unit 2M, and the C image formation unit 2C, the turning of the photosensitive material drum 22Y, 22M, 22C, the charging output of the charger 24Y, 24M, 24C, the exposure operation of the exposure apparatus 26Y, 26M, and the developing operation of the developing apparatus 28Y, 28M, 28C are stopped. More specifically, the driving of the charge bias power supply 94, the LD driver 82, the developing apparatus motor 84, the developing bias power supply 96, the transfer motor 86, the primary transfer bias power supply 98, and the photosensitive material motor 88 in the Y image formation unit 2Y, the M image formation unit 2M, and the C image formation unit 2C is stopped.

After step 206, or at step 202, when it has been determined that the image data (or the document) is of color, the program proceeds to step 208, it is determined whether an invisible image is to be printed out. Specifically, when the above-mentioned printing instruction is a copying instruction, and when the image data for which printing has been instructed from a PC or the like includes no image data for an invisible image, it is determined that the invisible image is not to be printed out. In addition, when the image data for which printing has been instructed from a PC or the like includes image data for an invisible image, it is determined that the invisible image is to be printed out.

At step 208, when it is determined that the invisible image is not to be printed out, the program proceeds to step 210 to set the system such that the output of the charger 24*i* in the i image formation unit 2*i* is lowered to a prescribed level, and to set the system such that the exposure operation of the exposure apparatus 26*i* and the developing operation of the developing apparatus 28*i* are stopped. In addition, the system is set such that application of a transfer bias to the transfer roller 48*i* in the i image formation unit 2*i* is stopped.

Herein, the output control of the charger 24*i* will be described in detail. The control apparatus 10 controls the charge bias power supply 94*i* in, for example, the ordinary operation, such that a prescribed charge bias is applied to the charger 24*i* by the charge bias power supply 94*i*. When the output of the charger 24*i* is to be lowered, the charge bias power supply 94*i* is controlled such that a charge bias at a level lower than that of the above-mentioned prescribed charge bias is applied. For example, in the ordinary operation, a voltage of −700 V DC is applied, being superimposed on a Vpp (a peak-to-peak voltage) of 1.6 kV AC, and in the low output operation, the AC voltage is lowered to 0 V, and the DC voltage is lowered to −400 V to be applied.

Figure 7:
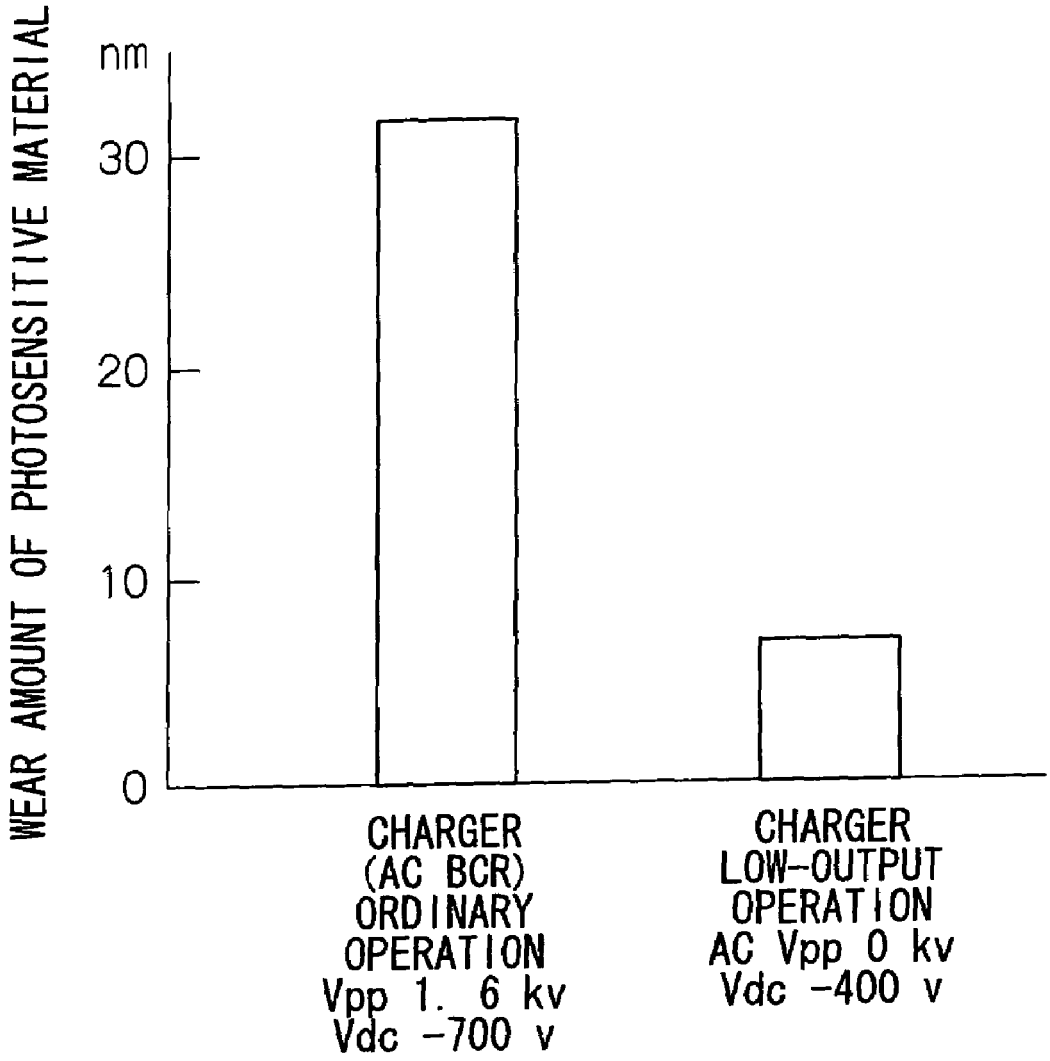
FIG. 7 is a diagram illustrating the amount of wear of the photosensitive material drum when the charger is operated in the ordinary operation mode, and in the low output operation mode to cause the photosensitive material drum to be charged for a prescribed period of time.

FIG. 7 is a diagram illustrating the amount of wear of the photosensitive material drum 22 when the charger 24 is operated in the ordinary operation mode, and in the low output operation mode to cause the photosensitive material drum 22 to be charged for a prescribed period of time. As can be seen from the same diagram, the amount of wear due to the discharge stresses, and the like, of the photosensitive material drum 22 is lower, when the charger 24 is operated in the low output operation mode.

After the processing at step 210, when it has been determined at step 208 that the invisible image is to be printed out, the program proceeds to step 212, and the printing operation is carried out in accordance with the above-mentioned setting. The printing operation is continued until it is determined at step 214 that the printing has been completed.

Herein, the formation operation of an image will be briefly described.

By the image formation unit(s), excluding the image formation unit(s) which is (are) set such that the image formation operation is stopped, an image is formed as follows.

The surface of the photosensitive material drum 22 is charged by the charger 24. The photosensitive material drum 22 which surface is charged by the charger 24 is exposed by the exposure apparatus 26, an electrostatic latent image being formed on the surface. And, to the photosensitive material drum 22 with which an electrostatic latent image has been formed, the toner corresponding to the pertinent image formation unit 2 is adhered by the developing apparatus 28 to form an image corresponding to the pertinent image formation unit 2.

Here, as described above, the photosensitive material drums 22 are disposed from the upstream side toward the downstream side along the running direction of "a" for the intermediate transfer belt 42, thus the respective toner images formed on the photosensitive material drums 22 by the respective image formation units 2 are sequentially transferred (primarily transferred) onto the intermediate transfer belt 42 by the respective transfer rollers 48 to be superimposed one upon another. After the transfer by the transfer roller 48, the toner left on the photosensitive material drum 22 is wiped off to be cleaned by the cleaner 50.

On the other hand, the recording paper is fed along the paper feed path "P" from the paper tray 14 toward between the intermediate transfer belt 42 and the secondary transfer roller 62, and inserted therebetween. When the recording paper is inserted between the intermediate transfer belt 42 and the secondary transfer roller 62, the transfer bias voltage is applied to the secondary transfer roller, the toner image transferred to the intermediate transfer belt 42 being electrostatically secondarily transferred to the surface of the recording paper. The recording paper onto which the toner image is transferred is conveyed along the paper feed path "P" to the fixing apparatus 64 further downstream, where the toner image on the recording paper is fixed before the recording paper being delivered.

When it is determined at step 214 that the printing operation has been completed, the program proceeds to step 216, the above-mentioned setting being rest with the program being returned to step 200.

Summarizing the control as described above with reference to the flowchart, the image formation operation with the image forming apparatus 100 in the present embodiment is controlled in the following manner depending upon the image to be formed.

When an invisible image is to be formed together with a black and white image, the intermediate transfer belt 42 is separated from the photosensitive material drum 22Y in the Y image formation unit 2Y, the photosensitive material drum 22M in the M image formation unit 2M, and the photosensitive material drum 22C in the C image formation unit 2C (see FIG. 2). In this state, only the i image formation unit 2*i* and the K image formation unit 2K are used for carrying out the image formation operation, with the image formation operation of the Y image formation unit 2Y, the M image formation unit 2M, and the C image formation unit 2C being stopped.

When a black and white image is to be formed with no invisible image being formed, the intermediate transfer belt 42 is separated from the photosensitive material drum 22Y in the Y image formation unit 2Y, the photosensitive material drum 22M in the M image formation unit 2M, and the photosensitive material drum 22C in the C image formation unit 2C (see FIG. 2). In addition, the charger 24*i* in the image formation unit 2*i* is operated in the low output mode, with the exposure operation of the exposure apparatus 26*i*, the developing operation of the developing apparatus 28*i*, the transfer operation of the transfer roller 48*i* being stopped. However, the turning of the photosensitive material drum 22*i* in the i image formation unit 2*i*, and the turning of the transfer roller 48*i* are provided. In other words, the image formation operation of the Y image formation unit 2Y, the M image formation unit 2M, and the C image formation unit 2C, and the i image formation unit 2*i* is stopped, and only the K image formation unit 2K is used for carrying out the image formation operation.

When an invisible image is to be formed together with a color image, the intermediate transfer belt 42 is butted against the photosensitive material drums 22 in all the image formation units 2 (see FIG. 1), the respective image formation units being driven as ordinarily for printing.

When a color image is to be formed with no invisible image being formed, the intermediate transfer belt 42 is butted against the photosensitive material drums 22 in all the image formation units 2 (see FIG. 1), the charger 24*i* in the i image formation unit 2*i* being operated in the low output operation mode, with the exposure operation of the exposure apparatus 26*i*, the developing operation of the developing apparatus 28*i*, the transfer operation of the transfer roller 48*i* being stopped. However, the turning of the photosensitive material drum 22*i* in the i image formation unit 2*i*, and the turning of the transfer roller 48*i* are provided. Thereby, the feed of the intermediate transfer belt 42 in the process direction can be performed smoothly, which can prevent the photosensitive material drum 22*i* from being friction charged. Thus, with the image formation operation of only the i image formation unit 2*i* of the five image formation units being stopped, a color image with no invisible image is printed.

As described above, with the image forming apparatus 100 in the present embodiment, when the K color toner and the i toner are used for formation of an image, the image formation operation of each of the Y image formation unit 2Y, the M image formation unit 2M, and the C image formation unit 2C is stopped, thus printing can be carried out with no loss of the invisible image, and the deterioration of the photosensitive material drum 22, and the degradation of the developer can be prevented.

More specifically, as described above, the invisible image also has an essential aspect of providing a strengthened security function, and thus even when a black and white image is to be formed, the invisible image cannot be considered to be dispensable. Therefore, by thus driving the i image formation unit 2*i* together with the K image formation unit 2K, not only a visible image made up of the K toner but also an invisible image having security information and the like can be formed on the recording paper, and thus a printed matter which is seemingly an ordinary black and white printing, but provides a great effect in prevention and suppression of leakage of information can be obtained.

In addition, during printing of a black and white image, the intermediate transfer belt 42 is separated from the photosensitive material drum 22Y, 22M, 22C in the Y image formation unit 2Y, the M image formation unit 2M, and the C image formation unit 2C, with the image formation operation of the Y image formation unit 2Y, the M image formation unit 2M, the C image formation unit 2C being not carried out, being halted, as shown in FIG. 2, thus the photosensitive material drum 22Y, 22M, 22C in the Y image formation unit 2Y, the M image formation unit 2M, the C image formation unit 2C, and the charger 24Y, 24M, 24C, the exposure apparatus 26Y, 26M, 26C, the developing apparatus 28Y, 28M, 28C, the cleaner 50Y, 50M, 50C around the photosensitive material drum 22Y, 22M, 22C are not used, thus the scratch damage, wear, and deterioration problems which would be caused with the photosensitive material drum 22Y, 22M, 22C are eliminated. In addition, degradation of the developer and the like can be prevented.

In addition, with the present embodiment, when an image is to be formed in full color, including an invisible image, the intermediate transfer belt 42 is butted against the photosensitive material drums 22 in all the image formation units 2, as shown in FIG. 1, with all the image formation units 2 being caused to implement the ordinary image formation operation, thus, the toner images formed on the photosensitive material drums 22 in all the image formation units 2 can be primarily transferred to the intermediate transfer belt 42, and collectively secondarily transferred to the recording paper to be fixed. Therefore, an invisible image having security information and the like can be formed together with a full-color visible image made up of the YMCK toners on the recording paper, and thus a printed matter which is seemingly an ordinary black and white printing, but provides a great effect in prevention and suppression of leakage of information can be obtained.

In addition, as shown in FIG. 1, the i image formation unit 2*i* is provided on the downstream side of the Y image formation unit 2Y, the M image formation unit 2M, and the C image formation unit 2C in the process direction, thus the effect that the loss of the i toner information is minimized can also be obtained. Here is a detailed description of this effect.

With an image forming apparatus which uses the intermediate element transfer method, the toners are sequentially superimposed one upon another on the intermediate transfer element (the intermediate transfer belt 42 in the present embodiment) (which is the primary transfer), and thereafter collectively transferred on the recording paper (which is the secondary transfer). At the time of this secondary transfer, a part of the toner which provides the bottom layer on the intermediate transfer element may be left on the intermediate transfer element without being transferred. In the secondary transfer, the transfers from that in the low-density highlight portion to that in the high-density portion where the toner is put in multiple layers must be carried out under the same transfer conditions, thus particularly in the high-density portion of a color image, the amount of transfer residual is increased.

Figure 8A:
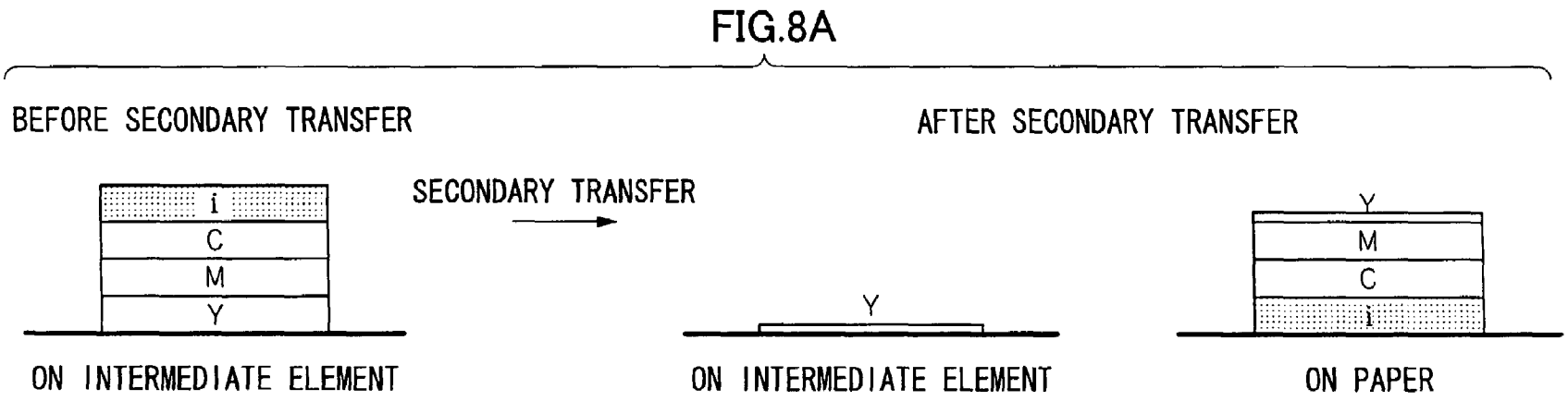
FIG. 8A is a drawing illustrating a primary transfer state and a secondary transfer state when a color image is formed together with an invisible image in the image forming apparatus in which the i image formation unit is provided on the downstream side of the Y image formation unit, the M image formation unit, and the C image formation unit in the process direction.
Figure 8B:
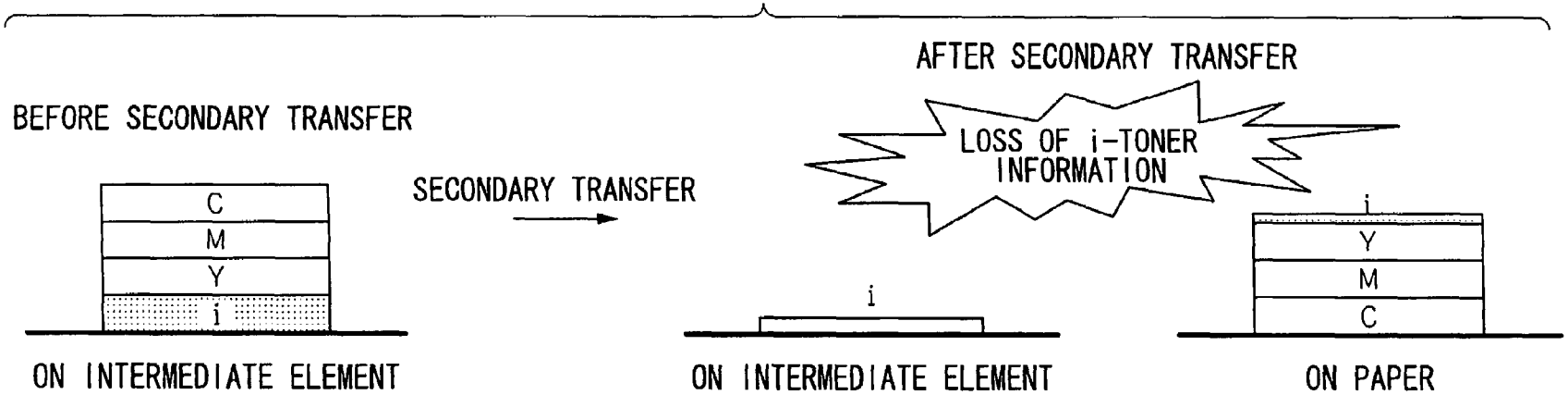
FIG. 8B is a drawing illustrating the primary transfer state and the secondary transfer state when a color image is formed together with an invisible image in the image forming apparatus in which the i image formation unit is provided on the upstream side of the Y image formation unit, the M image formation unit, and the C image formation unit in the process direction.

FIG. 8A is a drawing illustrating the primary transfer state and the secondary transfer state when a color image is formed together with an invisible image in the image forming apparatus in which the i image formation unit 2*i* is provided on the downstream side of the Y image formation unit 2Y, the M image formation unit 2M, and the C image formation unit 2C in the process direction, and FIG. 8B is a drawing illustrating the primary transfer state and the secondary transfer state when a color image is formed together with an invisible image in the image forming apparatus in which the i image formation unit 2*i* is provided on the upstream side of the Y image formation unit 2Y, the M image formation unit 2M, and the C image formation unit 2C in the process direction.

If the i image formation unit 2*i* were provided on the upstream side of the Y image formation unit 2Y, the M image formation unit 2M, and the C image formation unit 2C in the process direction as shown in FIG. 8B, the primary transfer would be carried out with the i toner layer, the Y color toner layer, the M color toner layer, and the C color toner being transferred in this order, thus the i toner layer would be formed at the bottom layer on the intermediate transfer belt 42. If the secondary transfer were carried out in this state, the Y color toner layer, the M color toner layer, and the C color toner layer would be normally transferred, but a part of the i toner layer which is directly contacted with the intermediate transfer belt 42 as the bottom layer would be left on the intermediate transfer belt 42. Therefore, a problem that the i toner is lost, and thus the additional information, such as the security information, and the like, included in the invisible image cannot be reliably transferred would be presented. As a solution to this problem, increasing the amount of the toner could be considered, however, when the accuracy of the information included in the invisible image is considered, this solution is not satisfactory, and the control of the amount of the toner would involve difficulty.

On the other hand, when the i image formation unit 2*i* is provided on the downstream side of the Y image formation unit 2Y, the M image formation unit 2M, and the C image formation unit 2C in the process direction as shown in FIG. 8A, the i toner is transferred lastly in the primary transfer, after the Y color toner layer, the M color toner layer, and the C color toner layer having been sequentially transferred, thus the i toner layer is formed as the top layer on the intermediate transfer belt 42. Then, when the secondary transfer is carried out in this state, a part of the Y color toner layer which is directly contacted with the intermediate transfer belt 42 as the bottom layer is left on the intermediate transfer belt 42, however, the i toner layer is normally transferred. Therefore, the loss of the i toner information can be minimized, and thus the security information and the like, included in the invisible image, can be reliably transferred, and a high-quality printed matter can be offered. Thereby, a case can be avoided where a printed matter is impossible to be utilized as a document in which additional information is embedded.

In addition, because the K image formation unit 2K and the i image formation unit 2*i* are provided adjacently to each other, with the i image formation unit 2*i* being provided on the downstream side of the Y, M, C image formation unit 2Y, 2M, 2C in the process direction, the intermediate transfer belt 42 can be separated from the photosensitive material drums 22 in the image formation units for the other colors which are not used for printing when a black and white image is to be formed, with a simple configuration, as compared to the case in which the K image formation unit 2K and the i image formation unit 2*i* are provided between other image formation units 2, and the case in which the K image formation unit 2K is provided, being separated from the i image formation unit 2*i*.

In addition, in the above-mentioned embodiment, the photosensitive material motor is provided for each image formation unit, but the configuration is not limited to this, and for example, the photosensitive material drums 22, and the like, in the Y, M, C image formation unit 2Y, 2M, 2C, which are driven simultaneously when a color image is formed, with the above-mentioned configuration, can be adapted to be driven by the same driving source, thus an apparatus having a simpler construction and thus being at a lower cost can be realized.

Further, with the above-mentioned image forming apparatus 100, the K image formation unit 2K is provided most downstream in the process direction, thus the FCOT (first copy output time), the time period from the moment when the user has issued a printing instruction to the moment when the image is outputted, can be shortened.

For example, when a black and white image is to be formed, only the K color toner is used to form an image, thus there is no need for carrying out the image formation operation in the other image formation units. Therefore, by disposing the K image formation unit 2K most downstream in the process direction, the time period from the moment when an image is formed in the image formation unit to the moment when the image is transferred to the recording paper can be shortened, which allows the FCOT to be minimized. Even if the image forming apparatus is that which is capable of printing a color image, black and white printing is frequently performed. Therefore, by minimizing the FCOT in the black and white image printing, the operation convenience for the users is improved.

The above-mentioned embodiment has been described with an example in which the image formation operation of the respective image formation units 2 is controlled on the basis of the data for the image for which printing has been instructed, however, the present invention is not limited to this, and for example, the system may be configured such that the user previously specifies the printing mode through the operating unit 12, or the like, and in accordance with the printing mode specified, the image formation operation in the respective image formation units 2 is controlled. For example, the system may be configured such that the printing mode in which an invisible image is printed out together with a black and white image, the printing mode in which an invisible image is printed together with a color image, the printing mode in which black and white printing is performed with no invisible image being printed, the printing mode in which color printing is performed with no invisible image being printed, and the like can be previously established, and the user can specify any of these printing modes. Even with such a configuration, the same effect as that of the above-mentioned embodiment can be obtained.

In addition, the above-mentioned embodiment has been described by exemplifying an image forming apparatus wherein, when black and white printing is carried out, the intermediate transfer belt 42 is separated from the photosensitive material drum 22Y, 22M, 22C in the Y image formation unit 2Y, the M image formation unit 2M, and the C image formation unit 2C, the image forming apparatus is not limited to this, and it may be, for example, an image forming apparatus wherein, instead of separating the intermediate transfer belt 42 from the photosensitive material drums 22, the transfer rollers 48 are withdrawn from the intermediate transfer belt 42. In this case, when black and white printing is carried out, the transfer roller 48Y, 48M, 48C in the Y image formation unit 2Y, the M image formation unit 2M, and the C image formation unit 2C is moved for withdrawal from the intermediate transfer belt 42. With such an image forming apparatus, the photosensitive material drum 22Y, 22M, 22C is kept contacted with the intermediate transfer belt 42, resulting in occurrence of wear due to the friction. Thus, it is preferable to keep the photosensitive material drum 22Y, 22M, 22C turning during black and white printing such that this friction being minimized.

At this time, the contact between the photosensitive material drum 22Y, 22M, 22C and the intermediate transfer belt 42 may cause the surface of the photosensitive material drum 22Y, 22M, 22C to be slightly friction-charged, thus it is preferable that the charger 24Y, 24M, 24C is operated at a low output to suppress the friction charging as shown in FIG. 7.

In addition, the above-mentioned embodiment has been described by exemplifying a toner which has an infrared light absorption characteristic, and becomes visible when irradiated with infrared light, as the invisible toner to be used for forming an invisible image, however, the invisible toner is particularly not limited to this, provided that it can form an image which is difficult or impossible to be visually recognized under the ordinary environment (i.e., an invisible image), and for example, it may be a toner which has an ultraviolet light absorption characteristic, and becomes visible when irradiated with ultraviolet light.

In addition, the above-mentioned embodiment has been described by exemplifying an image forming apparatus which uses the intermediate element transfer method, but the image forming apparatus is not limited to this, and it may be, for example, an image forming apparatus wherein an image formed in the respective image formation units is directly transferred to the recording medium fed by the paper transfer belt. When an invisible image is to be formed together with a black and white image with such image forming apparatus, the driving of the Y image formation unit 2Y, the M image formation unit 2M, and the C image formation unit 2C is stopped, with the paper transfer belt being separated from the photosensitive material drum 22Y, 22M, 22C in the Y image formation unit 2Y, the M image formation unit 2M, and the C image formation unit 2C. Even with this, the same effect as that as mentioned above can be obtained.

The above-mentioned embodiment has been described using an example in which, when a black and white image is formed, the driving of the Y image formation unit 2Y, the M image formation unit 2M, and the C image formation unit 2C is stopped, and the outer surface of the intermediate transfer belt 42 is separated from the photosensitive material drum 22Y, 22M, 22C, but the present invention is not limited to this, and for example, only the separation of the outer surface of the intermediate transfer belt 42 from the photosensitive material drum 22Y, 22M, 22C may be provided. In other words, even if a toner image is formed in the Y image formation unit 2Y, the M image formation unit 2M, and the C image formation unit 2C, separating the outer surface of the intermediate transfer belt 42 from the photosensitive material drum 22Y, 22M, 22C will cause only the toner image formed in the i image formation unit 2*i* and the K image formation unit 2K to be transferred, which allows a high-quality black and white image to be formed.

In the present invention, the control apparatus can stop the image formation operation of each of the cyan color image formation unit, the magenta color image formation unit, and the yellow color image formation unit by stopping of at least one of the turning of the image carrier, the charging output of the charger, the exposure operation of the exposure apparatus, and the developing operation of the developing apparatus in each of the cyan color image formation unit, the magenta color image formation unit, and the yellow color image formation unit, or by lowering the charging output of the charger to a prescribed level.

Thus, by stopping the image formation operation of each image formation unit, scratch damage and wear of the image carrier, and the like, degradation of the developer, and the like can be prevented.

In addition, the image forming apparatus of the present invention further includes a transfer section for transferring each image formed on the respective image carriers in the cyan color image formation unit, the magenta color image formation unit, the yellow color image formation unit, the black color image formation unit, and the invisible image formation unit to a transfer belt or a recording medium on a paper transfer belt, and when only the black color toner and the invisible toner are used for forming an image, the control apparatus can further disengages the respective image carriers in the cyan color image formation unit, the magenta color image formation unit, and the yellow color image formation unit, from the transfer belt or the paper transfer belt.

Thus, by separating the image carrier from the transfer belt or the paper transfer belt, the image carrier being locally rubbed to cause friction charging and be worn can be prevented when the turning of the image carrier in the image formation unit which is not used for printing is stopped.

In the present invention, the black color image formation unit can be provided adjacently to the invisible image formation unit.

According to such a configuration, when only the black color toner and the invisible toner are used to form an image, only the image carriers in the black color image formation unit and the invisible image formation unit can be butted against the transfer belt or the paper transfer belt, and the image carriers in the image formation units for the other colors (cyan, magenta, and yellow) can be separated from the transfer belt or the paper transfer belt with a simple mechanism. In addition, there is an advantage that, when the respective image carriers are to be driven for turning, the same power supply can easily be used.

In addition, in the present invention, the invisible image formation unit can be provided on the downstream side of the cyan color image formation unit, the magenta color image formation unit, and the yellow color image formation unit in the process direction.

With an image forming apparatus using the intermediate element transfer method, the toners are sequentially put on the intermediate element (which is the primary transfer), and thereafter collectively transferred on the paper (which is the secondary transfer), however, in this secondary transfer, a part of the toner at the bottom layer that is contacted with the intermediate element may be left, being adhered to the intermediate element. An invisible image by the invisible toner often includes additional information, such as security information and the like, and the loss of such information is not preferable. Therefore, by providing the invisible image formation unit for forming an invisible image using the invisible toner on the downstream side of the cyan color image formation unit, the magenta color image formation unit, and the yellow color image formation unit, the loss of the invisible toner, i.e., the loss of the information which is to be recorded with the invisible toner can be prevented.

In the present invention, the black color image formation unit can also be provided most downstream in the process direction.

Thereby, in forming a black and white image, the FCOT (first copy output time), the time period from the moment when the user has issued a printing instruction to the moment when the image is outputted, can be shortened.

For example, when a black and white image is to be formed, only the black color toner is used to form an image, thus there is no need for carrying out the image formation operation in the other image formation units. Therefore, by disposing the black image formation unit most downstream in the process direction, the time period from the moment when an image is formed in the image formation unit to the moment when the image is transferred to the recording medium can be shortened, which allows the FCOT to be minimized.

As described above, according to the present invention, when a black and white image is to be formed together with an invisible image in an image forming apparatus which is capable of forming a color image, excellent effects that the loss of the invisible image may be prevented, and the degradation of the image carrier and the developer may be prevented is provided.

As described above, the first embodiment of the present application is configured to include a cyan color image formation unit which uses a cyan color toner to form a cyan color image, a magenta color image formation unit which uses a magenta color toner to form a magenta color image, a yellow color image formation unit which uses a yellow color toner to form a yellow color image, a black color image formation unit which uses a black color toner to form a black color image, an invisible image formation unit which uses an invisible toner to form an invisible image, and a control apparatus which, when only the black color toner and the invisible toner are used for formation of an image, functions so as to stop respective image formation operations of the cyan color image formation unit, the magenta color image formation unit and the yellow color image formation unit.

Thus, because the image forming apparatus of the first aspect includes the cyan color image formation unit, the magenta color image formation unit, the yellow color image formation unit, the black color image formation unit, and the invisible image formation unit, it is capable of forming a black and white image, a color image, and an invisible image.

The control apparatus in the image forming apparatus of the first aspect stops the respective image formation operations of the cyan color image formation unit, the magenta color image formation unit, and the yellow color image formation unit, when only the black color toner and the invisible toner are used for formation of an image.

Thus, even when a black and white image is to be formed together with an invisible image in the image forming apparatus which is capable of forming a color image, the black and white image and the invisible image can be formed with the image formation operations of the black color image formation unit and the invisible image formation unit being not stopped. Accordingly, loss of the invisible image is prevented, and degradation of the image carriers, the developers, and the like, which constitute the color image formation units other than the black color image formation unit and the invisible image formation unit can be prevented.

An image forming apparatus of a second aspect of the present invention is configured to include a cyan color image formation unit which uses a cyan color toner to form a cyan color image, a magenta color image formation unit which uses a magenta color toner to form a magenta color image, a yellow color image formation unit which uses a yellow color toner to form a yellow color image, a black color image formation unit which uses a black color toner to form a black color image, an invisible image formation unit which uses an invisible toner to form an invisible image, a transfer section for transferring each image formed on respective image carriers in the cyan color image formation unit, the magenta color image formation unit, the yellow color image formation unit, the black color image formation unit, and the invisible image formation unit to a transfer belt or a recording medium on a paper transfer belt, and a control apparatus which, when only the black color toner and the invisible toner are used for forming an image, disengages the respective image carriers in the cyan color image formation unit, the magenta color image formation unit, and the yellow color image formation unit, from the transfer belt or the paper transfer belt.

Because the image forming apparatus of the second aspect includes the cyan color image formation unit, the magenta color image formation unit, the yellow color image formation unit, the black color image formation unit, and the invisible image formation unit, it is capable of forming a black and white image, a color image, and an invisible image.

The control apparatus in the image forming apparatus of the second aspect disengages the respective image carriers in the cyan color image formation unit, the magenta color image formation unit, and the yellow color image formation unit, from the transfer belt or the paper feed belt, when only the black color toner and the invisible toner are used for formation of an image. Thus, even when a black and white image is to be formed together with an invisible image in the image forming apparatus which is capable of forming a color image, the black and white image and the invisible image can be formed using the black color image formation unit and the invisible image formation unit, whereby the loss of the invisible image is prevented. In addition, even when a toner image is formed in the color image formation units other than the black color image formation unit and the invisible image formation unit, the toner image will not be transferred to the transfer belt or the recording medium on the paper transfer belt.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

a cyan color image formation unit which uses a cyan color toner to form a cyan color image;

a magenta color image formation unit which uses a magenta color toner to form a magenta color image;

a yellow color image formation unit which uses a yellow color toner to form a yellow color image;

a black color image formation unit which uses a black color toner to form a black color image;

an invisible image formation unit which uses an invisible toner to form an invisible image; and a control apparatus which stops respective image formation operations of the cyan color image formation unit, the magenta color image formation unit, and the yellow color image formation unit when only the black color toner and the invisible toner are used for formation of an image, by lowering charging output of respective chargers in the cyan color image formation unit, the magenta color image formation unit and the yellow color image formation unit to a prescribed level.

2. An image forming apparatus, comprising:

a cyan color image forma unit which uses a cyan color toner to form a cyan color image;

a magenta color image formation unit which uses a magenta color toner to form a magenta color image;

a yellow color image formation unit which uses a yellow color toner to form a yellow color image;

a black color image formation unit which uses a black color toner to form a black color image;

an invisible image formation unit which uses an invisible toner to form an invisible image;

a control apparatus which stops respective image formation operations of the cyan color image formation unit, the magenta color image formation unit, and the yellow color image formation unit when only the black color toner and the invisible toner are used for formation of an image; and a transfer section for transferring each image formed on respective image carriers in the cyan color image formation unit, the magenta color image formation unit, the yellow color image formation unit, the black color image formation unit and the invisible image formation unit to any of a transfer belt and a recording medium on a paper conveying belt, wherein, when only the black color toner and the invisible toner are used for forming the image, the control apparatus disengages the respective image carriers in the cyan color image formation unit, the magenta color image formation unit, and the yellow color image formation unit from any of the transfer belt and the paper conveying belt.

3. The image forming apparatus of claim 2, wherein the transfer section comprises a plurality of transfer rollers which turns and contacts with any of the transfer belt and the paper conveying belt, for transferring each of the cyan color image, the magenta color image, the yellow color image, the black color image, and the invisible image, the control apparatus, when an image is to be formed with the use of only the lack color toner, disengages the respective image carriers in the cyan color image formation unit,the magenta color image formation unit, and the yellow color image formation unit from any of the transfer belt and the paper conveying belt, lowers the charging output of the charger in the invisible image formation unit, stops an exposure operation of an exposure apparatus, a developing operation of a developing apparatus, and a transfer operation of a transfer roller in the invisible image formation unit, and rotates the image carrier and the transfer roller in the invisible image formation unit.

4. The image forming apparatus of claim 2, further comprising a support member which movably supports a part of the transfer section.

5. An image forming apparatus, comprising:

a cyan color image formation unit which uses a cyan color toner to form a cyan color image;

a magenta color image formation unit which uses a magenta color toner to form a magenta color image;

a yellow color image formation unit which uses a yellow color toner to form a yellow color image;

a black color image formation unit which uses a black color toner to form a black color image;

an invisible image formation unit which uses an invisible toner to form an invisible image;

a transfer section for transferring each image formed on respective image carriers in the cyan color image formation unit, the magenta color image formation unit, the yellow color image formation unit, the black color image formation unit, and the invisible image formation unit to any of a transfer belt and a recording medium on a paper conveying belt, and a control apparatus which, when only the black color toner and the invisible toner are used for forming the image, disengages the respective image carriers in the cyan color image formation unit, the magenta color image formation unit, and the yellow color image formation unit from any of the transfer belt and the paper conveying belt.

6. An image forming apparatus of claim 5, wherein the transfer section comprises a plurality of transfer rollers which turns and contacts with any of the transfer belt and the paper conveying belt for transferring each of the cyan color image, the magenta color image, the yellow color image, the black color image, and the invisible image, the control apparatus, when an image is to be formed with the use of only the black color toner, disengages the respective image carriers in the cyan color image formation unit, the magenta color image formation unit, and the yellow color image formation unit from any of the transfer belt and the paper conveying belt, lowers the charge output of the charger in the invisible image formation unit, stops an exposure operation of an exposure apparatus, a developing operation of a developing apparatus, and a transfer operation of a transfer roller in the invisible image formation unit, and rotates the image carrier and the transfer roller in the invisible image formation unit.

7. The image forming apparatus of claim 5, further comprising a support member which movably supports a part of the transfer section.

8. The image forming apparatus of claim 5, wherein the black color image formation unit and the invisible image formation unit are provided adjacent to each other.

9. The image forming apparatus of claim 5, wherein the invisible image formation unit is provided on the downstream side of the cyan color image formation unit, the magenta color image formation unit, and the yellow color image formation unit in the process direction.

10. The image forming apparatus of claim 5, wherein the black color image formation unit is provided furthest downstream in the process direction.

* * * * *